US005109472A

United States Patent [19]

Kwok

[11] Patent Number: 5,109,472

[45] Date of Patent: Apr. 28, 1992

[54] WATER HEATER WITH REMOVABLE IMPURITIES COLLECTOR AND BACKFLOW PREVENTING INLET PIPE

[76] Inventor: Chun W. Kwok, 6/F., Flat 24, Mei King Phase I, 2 Mei King Street, Tokwawan, Kowloon, Hong Kong

[21] Appl. No.: 451,690

[22] Filed: Dec. 18, 1989

[30] Foreign Application Priority Data

Dec. 16, 1988 [GB] United Kingdom ..... 8829336

[51] Int. Cl.[5] ..... F24H 1/00

[52] U.S. Cl. ..... 392/441; 392/477; 392/478; 392/480; 392/465

[58] Field of Search ..... 219/310, 312, 314, 316, 219/318, 441, 438; 126/274, 251, 362, 364; 122/321, 244, 281; 137/215, 216, 216.1, 216.2, 218; 392/441, 442, 444, 450, 451, 465, 468, 471-474, 477, 478, 480, 482, 486, 488; 99/281, 294

[56] References Cited

U.S. PATENT DOCUMENTS 758,188 4/1904 Miller ..... 137/216
4,480,173 10/1984 Butterfield ..... 219/312
4,825,043 4/1989 Knauss ..... 219/298

FOREIGN PATENT DOCUMENTS 2079908 5/1984 United Kingdom .

*Primary Examiner*—Bruce A. Reynolds
*Assistant Examiner*—Tu Hoang
*Attorney, Agent, or Firm*—James A. Wong

[57] ABSTRACT

A water heater (10) overcomes the disadvantage of complicated structure in the prior art and can effectively prevent water in the tank from flowing back into main supply outside the tank, remove impurities in hot water to improve water quality, assure effective and safe operation of the water heater and prolong its service life through the use of a simple ventilating member (20) having small holes (26) preventing water from flowing back, a guiding pipe (24) which makes water swirl, a downwardly projecting periphery (14) of the bottom of the tank, a sand collector (16) and a manually operated sand removing valve (18).

7 Claims, 2 Drawing Sheets

WATER HEATER WITH REMOVABLE IMPURITIES COLLECTOR AND BACKFLOW PREVENTING INLET PIPE

BACKGROUND OF THE INVENTION

This invention relates to water heaters and especially but not exclusively to a non-pressurized type electric water heater with automatic thermostatic control suitable for domestic use.

British Patent published on 16th May 1984 under Patent No. 2079908 disclosed a water heater capable of generating hot water from room temperature to boiling temperature and also for generating steam on demand. The device comprises a water tank having a water inlet with valve means for allowing or not allowing water to enter into the tank, a one-way valve to prevent the water in the tank from flowing back into the main supply and a pressure reducing valve for ensuring that the water pressure in the inlet water pipe and in the tank does not exceed a pre-set level, means for detecting the water level in the tank, means for heating the water in the tank, means for detecting the temperature of the water in the tank, hot water outlet means disposed at the bottom of the tank, steam outlet means located at the top of the tank, and control means receiving signals from the water level detecting means, the temperature detecting means and a temperature programmer to control the pressure, temperature of water in the tank and the water inlet valve means. The water heaters thus constructed have the advantage of being energy saving, fast and practical. However, this kind of water heater cannot remove sand and other impurities in water, resulting in unfavourable influence on quality of water. Furthermore, in the course of long-term usage, the incrustation precipitated on the inner-wall of the tank will degrade the heat-efficiency and the service life of the tank. In addition, this kind of water heater is rather complicated in structure. In the applications where only hot water adjustable within a certain range of temperature is required, it is not necessary to use this kind of water heater. It is advisable to use a more simplified water heater.

SUMMARY OF THE INVENTION

Therefore, it is desirable to provide an electric water heater which is simplified in structure and can provide hot water adjustable in a certain range of temperature.

It is also desirable to provide an electric water heater which can automatically remove impurities in hot water so as to purify water, prolong its service life and to maintain the high heat-efficiency.

The water heater according to one embodiment of the present invention includes a water tank, the periphery of the bottom of which projects downwardly and is connected to a sand and impurities collector below. The bottom of the sand and impurities collector is provided with a hand-manipulated sand removing valve. Provided in the tank is an inlet waterpipe. One end of the inlet waterpipe is located at the inlet of water supply located at the bottom wall of the tank. The inlet waterpipe has an inverted U-shaped structure located near the top of the tank. The other end of the inlet waterpipe extends downwardly and then outwardly to form a guiding waterpipe. This inverted U-shaped waterpipe forms a ventilated member having small holes to prevent water in the tank from flowing back into the main water supply.

Furthermore, the guiding waterpipe enables water flow to rotate by slightly bending its outwardly extending end, so as to drive the sand and impurities in the water to precipitate onto the downwards projecting periphery of the bottom of the tank.

The central part of the top of the tank has an arch form. In the tank there is a hot water outlet pipe, the upper end of which is situated in the domed part of the arch and the lower end of which is connected to the water outlet of the tank.

Within a central portion of the tank, there is an electric heating element, at a suitable distance from which a water temperature detecting means is disposed to detect the temperature of the water in the tank.

Outside the tank there is a hot water temperature indicator for indicating the temperature of hot water in the tank, an automatic thermostat for regulating the temperature of water to a pre-set value and a fuse which will break the circuit of the electric heating element as soon as the temperature of hot water surpasses the pre-set value. The temperature indicator, the thermostat and the fuse assembly are all connected to the water temperature detecting means.

When water enters the tank through the inverted U-shaped waterpipe and guiding waterpipe, it will bring about a rotating momentum, so as to make sand and impurities in the water precipitate onto the downwardly projecting periphery of the bottom of the tank and finally into the sand collector, which will be flushed away with water by opening and removing the valve.

Furthermore, the ventilated means having small holes for preventing water flowing back has such a function: when no water enters into the inlet waterpipe or the outlet hot waterpipe stops sending out hot water, it will prevent water in the tank from flowing back into the main water supply. This is very important, because if water flows back from the tank, there is the possibility that the water level in the tank will drop below the electric heating element and the electric heating wire and that the water heater will be damaged when the electric heating wire is energized.

Thus the water heater according to the preferred embodiment, through the use of simple ventilated member having small holes and preventing water from flowing back, guide waterpipe enabling water to swirl, the downwardly projecting periphery of the bottom of the tank, sand collector and sand removing valve, can effectively prevent water in the tank from flowing back, remove impurities in the water, ensure its high-effective and safe operation and prolong its service life.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
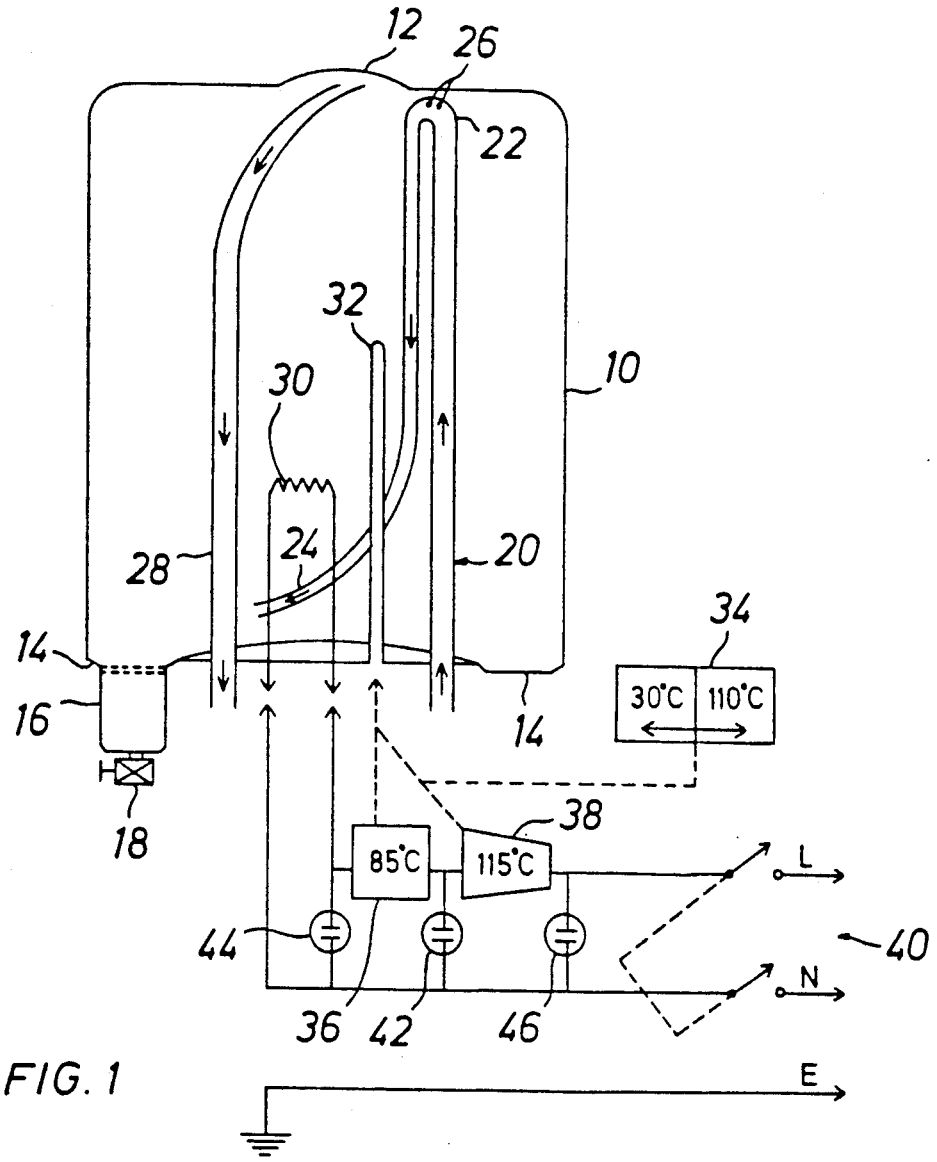
FIG. 1 is a schematic diagram of an electric water heater of a non-pressurized type and with automatic thermostatic control in accordance with one embodiment of the present invention.
Figure 2:
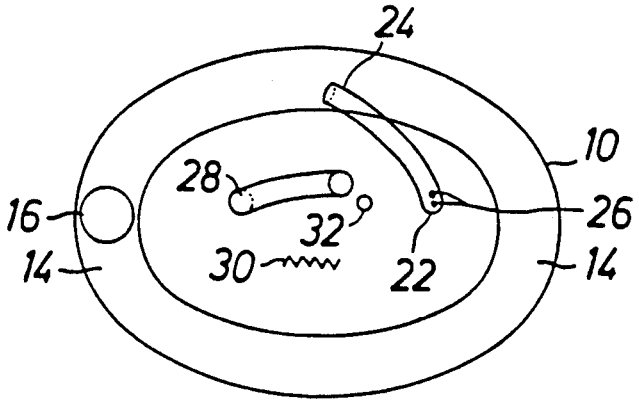
FIG. 2 is a top view of the water tank shown in FIG. 1.

Referring now to FIGS. 1 and 2, a water tank 10 has, according to the present embodiment, an elliptical cross section and is made of heat-resistant plastics or other suitable materials. The top of the tank 10 presents a domed arch 12 and the periphery 14 of its bottom projects downwards. Under the projecting periphery 14 of the tank 10 there is a sand and impurities collector 16, which is connected with water tank 10 by threads or other means and under the bottom of which there is mounted a manually operated sand removing valve 18.

In the tank 10 there is an inlet waterpipe 20, the lower end of which is located at the bottom of tank 10. The inlet waterpipe 20 has an inverted U-shaped portion 22 near the top of the tank 10. The other end of the inverted U-shaped portion 22 of the inlet waterpipe 20 extends outwardly to form a guiding waterpipe 24. The free end of the guiding waterpipe 24 is bent slightly and its outlet is above the circular downwardly projecting periphery 14 of the bottom of the tank 10. On the top of the inverted U-shaped portion 22 of the inlet waterpipe 20 there are provided, according to the present embodiment, two small holes 26 so as to form a ventilated member having small holes for preventing water in the tank 10 from flowing back. It can prevent water in the tank 10 from flowing back into the main water supply outside the tank 10 when no water enters the inlet waterpipe 20 or outlet hot waterpipe 28 stops sending out hot water. The small holes 26 preferably have a diameter of about 1 mm. In many cases it is not suitable to have a larger diameter. If a large diameter is used, the water in the inlet waterpipe 20 can leak out from the small holes 26 when passing through the inverted U-shaped portion 22 section. On the other hand, if the hole is too small, it is liable to block. It is recommended that in the preferred embodiment the small holes 26 have a diameter between 0.6 mm and 1.5 mm.

In the water tank 10 there is a hot water outlet pipe 28. Its upper end is bent towards the centre of the top of the tank 10 and its inlet is located in the central domed arch part 12 of the top of water tank 10. The domed arch part 12 serves to facilitate the flow of water into the hot water outlet pipe 28. As soon as the cold water supply is shut off, only a relatively small amount of hot water within the domed arch portion 12 would flow into the outlet pipe 28. The lower outlet of the hot water outlet pipe 28 is located at the bottom of tank 10. The inlet waterpipe 20 and the outlet hot waterpipe 28 are preferably made of metal. The cold water flows into the tank 10 through the inlet waterpipe 20 while the hot water flows out through outlet hot waterpipe 28, and the direction is indicated by arrows in FIG. 1.

In a front portion of the water tank 10 there is provided an electric heating element 30. In this embodiment an electric heating wire is used as electric heating element to heat up the water in the tank 10.

Near the rear portion of the tank 10 and at a suitable distance from the electric heating wire there is a water temperature detecting tube 32 to detect the temperature of water in the tank 10.

Outside the tank 10 there is a hot water temperature indicator 34 to indicate the temperature of water in the tank 10 and a thermostat 36, which is also connected to the water temperature detecting tube 32 to adjust automatically the temperature to a pre-set value, with the highest adjustable temperature being 85° C. A fuse 38, for breaking the circuit when too high a temperature occurs, is also connected to the water temperature detecting tube 32, and when the temperature of water reaches 115° C., the fuse wire will melt so as to break the circuit of the electric heating wire. An indicating light 42 serves as a self-diagnostic light signal to indicate malfunction of the heating element 30 and the thermostat 36.

In addition, the circuit also comprises a double pole single throw switch 40 for power supply, power supply indicating light 46, indicating light 44 of the automatic thermostat and the metal part of the device is connected to the ground. The indicating lights 42, 44 and 46, in the form of neon lights, are arranged and mounted on the outer case of the water heater thereby providing visual indicating and warning signals for users. The indicating lights 42, 44 and 46 may be of different colours for recognition purposes.

When water enters the inlet waterpipe 20 flowing through the inverted U-shaped portion 22, the guiding waterpipe 24 and into the water tank 10, the rotating momentum thus produced makes the water swirl in the tank 10 so as to make sand and other impurities precipitate onto the circular downwardly projecting part 14 and finally to push them into the sand collector 16. At a proper time the sand removing valve 18 will be opened up to wash away sand and other impurities accumulated in the sand collector 16 with water.

Figure 3:
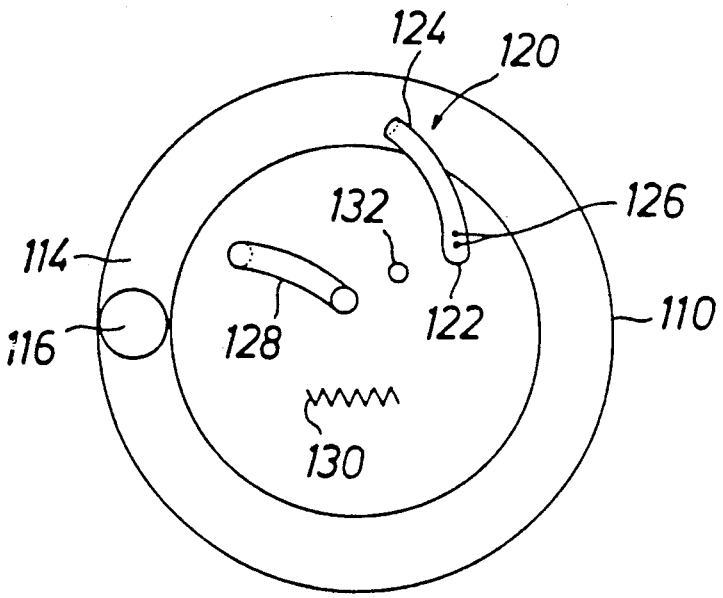
FIG. 3 is a similar view to FIG. 2 showing a second embodiment of the water tank.

FIG. 3 is a similar view of FIG. 2 showing a second embodiment of the water tank of the present invention. The water tank, having a circular cross section, is represented by reference numeral 110. The round bottom wall of the tank 110 has a downwardly projected periphery portion defining an annular recess 114. A sand and impurities collector 116 is connected to a bottom portion of the downwardly projected periphery portion of the tank 110. A sand and impurities removing valve is provided at the bottom of the sand and impurities collector 116 for sand and impurities removal.

Generally indicated by reference humeral 120 is a cold water inlet waterpipe. The cold water inlet waterpipe 120 comprises, as similar to the inlet waterpipe of the previous embodiment, an inverted U-shaped portion 122 having two small holes 126 which act to prevent water in the tank 110 from flowing backwards.

The inlet waterpipe 120 extends outwardly to form a guiding waterpipe 124. The free end of the guiding water pipe 124 is bent slightly such that its outlet is positioned above the annular recess 114 of the tank 110.

A heating element 130 is provided in the tank 110 at a front portion thereof.

A hot water outlet pipe 128 and a water temperature detecting tube 132 are further provided in the tank 110 at a rear portion thereof, and are generally disposed, together with the inlet waterpipe 120, in a plane at a distance from the heating element 130, as shown in FIG. 3.

The cylindrically shaped water tank 110 and the annular recess 114 serve to produce a swirling effect rendering sand and impurities precipitated on the bottom wall of the water tank to swirl around the annular recess 114 and eventually collected by the sand and impurities collector 116.

The guiding waterpipe may be held into position by reinforcement means. This reinforcement means can take the form of an arcuate plastic or metal sheet with the top edge mounted to the waterpipe; the bottom edge mounted to the bottom wall of the tank; and a side edge mounted to the vertical inlet portion of the cold water inlet waterpipe. The reinforcement means curves and extends generally in the direction of the swirl of water in the tank.

Although the water tank has been described as having an elliptical or circular cross section, it is contemplated that the water tank may be of other shape or configuration. For example, the water tank may have a lower end portion of circular cross section to effect swirling of water along the annular recess, and the remaining portion of elliptical or elongated cross section to provide a slimly shaped water tank body.

I claim:

1. A water heater device, comprising a water tank having an inlet waterpipe, an outlet hot waterpipe, an electric heating element for heating the water in the tank, a water temperature detecting means for detecting the temperature of the water in the tank, to which are connected a hot water temperature indicator, an automatic thermostat, and a fuse for breaking circuit when high temperature occurs, is characterized in that said water tank has a bottom including a main or central inner surface with a downwardly projecting peripheral portion extending therearound, said inlet waterpipe has an inverted U-shaped portion near th top of the tank, one end of the inverted U-shaped portion extends downwardly and then outwardly to form a guiding waterpipe to guide incoming water to issue over said downwardly projecting peripheral portion, at least one small hole provided on the top of the inverted U-shaped portion of the waterpipe, a sand and impurities collector located under and connected to said downwardly projecting peripheral portion and having a sand and impurities removing valve.

2. A water heat as claimed in claim 1, wherein the diameter of the said small hole is between 0.6 mm to 1.5 mm.

3. A water heater as claimed in claim 1 wherein the end of the said guiding waterpipe bends slightly so that its outlet is located above the downwardly projecting peripheral portion of the bottom of said tank.

4. A water heater as claimed in claim 1, 2 or 3 wherein said collector is threadingly connected to the tank.

5. A water heater as claimed in claim 1, 2, or 3 wherein said water tank has an elliptical cross section.

6. A water heater as claimed in claim 1, 2, or 3, wherein said water tank has a circular cross section.

7. A container for storing heated water, comprising a base with a peripherally extending trough, said trough having an outlet from which precipitate can be removed; and an inlet conduit, through which water to be heated can be supplied to the container, extending upwardly from a lower region of the container into a curved position at an upper region of the container and thence extending generally downwardly and outwardly so as to guide incoming water to issue over said trough, the curved portion of the conduit being apertured to permit water in the inlet conduit to issue into the container, thereby preventing it from flowing from the container through the inlet conduit when the supply of water is halted.

* * * * *